US009004279B2

(12) United States Patent
Ludwig et al.

(10) Patent No.: US 9,004,279 B2
(45) Date of Patent: Apr. 14, 2015

(54) PILL CONTAINER CARRIER

(71) Applicants: Christopher Ludwig, Buffalo Grove, IL (US); Leslie S. Marco, Westmont, IL (US); Robert C. Olsen, Medinah, IL (US)

(72) Inventors: Christopher Ludwig, Buffalo Grove, IL (US); Leslie S. Marco, Westmont, IL (US); Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/840,548

(22) Filed: Mar. 15, 2013

(65) Prior Publication Data

US 2014/0027341 A1 Jan. 30, 2014

Related U.S. Application Data

(60) Provisional application No. 61/675,218, filed on Jul. 24, 2012, provisional application No. 61/675,224, filed on Jul. 24, 2012.

(51) Int. Cl.

| | |
|---|---|
| ***B65D 75/00*** | (2006.01) |
| ***B65D 83/04*** | (2006.01) |
| ***B65D 77/04*** | (2006.01) |
| ***B65D 71/50*** | (2006.01) |
| ***B65D 75/02*** | (2006.01) |
| ***B65D 75/42*** | (2006.01) |

(52) U.S. Cl.

CPC ..... *B65D 83/04* (2013.01); *B65D 77/042* (2013.01); *B65D 71/50* (2013.01); *B65D 75/02* (2013.01); *B65D 75/42* (2013.01)

(58) Field of Classification Search

CPC ..... B65D 71/063; B65D 71/48; B65D 71/50; B65D 71/504; B65D 75/02; B65D 75/42; B65D 75/563; A61J 1/03

USPC ..... 53/48.1, 48.3–48.7, 134.1, 136.1, 53/139.1, 398–399, 582; 206/139, 206/145–146, 150–151, 153, 155, 162, 195, 206/430; 220/737; 294/87.2, 87.28

IPC ..... B65D 25/20, 25/22

See application file for complete search history.

(56) References Cited

U.S. PATENT DOCUMENTS

| | | | | |
|---|---|---|---|---|
| 3,561,594 | A * | 2/1971 | Jorgensen | 206/430 |
| 4,799,723 | A * | 1/1989 | Mahaffy | 294/87.2 |
| 5,441,147 | A * | 8/1995 | Tanner | 206/150 |
| 6,152,508 | A * | 11/2000 | Slomski | 294/87.2 |
| 6,186,327 | B1 * | 2/2001 | Hadden | 206/472 |
| 2003/0192788 | A1 * | 10/2003 | Marco | 206/147 |
| 2008/0181539 | A1 * | 7/2008 | Marco | 383/7 |
| 2008/0272013 | A1 * | 11/2008 | Hartness et al. | 206/139 |
| 2009/0094938 | A1 * | 4/2009 | Biernat et al. | 53/48.4 |
| 2009/0101662 | A1 * | 4/2009 | Marco et al. | 220/737 |
| 2011/0186470 | A1 * | 8/2011 | Ganti | 206/538 |
| 2011/0272299 | A1 * | 11/2011 | Smith | 206/175 |
| 2012/0125983 | A1 * | 5/2012 | Percival et al. | 229/5.5 |

* cited by examiner

*Primary Examiner* — Bryon Gehman
*Assistant Examiner* — Brijesh V. Patel
(74) *Attorney, Agent, or Firm* — Pauley Petersen & Erickson

(57) ABSTRACT

An apparatus for packaging medication including a plurality of containers having a generally rectangular cross-section, each container for holding medication and one or more flexible sleeves, each flexible sleeve for accommodating two containers arranged in transverse ranks. The resulting package may be arrayed in multiple rows and ranks of containers.

9 Claims, 9 Drawing Sheets

PILL CONTAINER CARRIER

CROSS REFERENCE TO RELATED APPLICATIONS

This application claims the benefit of U.S. Provisional Patent Application Ser. No. 61/675,218, filed 24 Jul. 2012 and U.S. Provisional Patent Application Ser. No. 61/675,224, filed 24 Jul. 2012. The Provisional Applications are hereby incorporated by reference herein in their entirety and are made a part hereof, including but not limited to those portions which specifically appear hereinafter.

BACKGROUND OF THE INVENTION

1. Field of the Invention

This invention relates to a flexible sleeve for carrying a plurality of generally flat pill containers.

2. Description of Prior Art

Conventional pill bottles generally include a cylindrical body with a threaded child-safe cap. Such conventional pill bottles are expensive to ship because of the packaging and postage required. As such, mail order prescription services spend millions of dollars annually to box and ship prescriptions. Conventional mailing envelopes often result in crushed or otherwise compromised medications from the rigors of mail handling and sorting equipment, transport and delivery.

A recently developed container for prescription medication is an "M-Pack" container manufactured by Juno Techologies LLC of San Diego, Calif. The M-Pack container is a generally flat box with a locking, sliding top for dispensing pills. The M-Pack container can be shipped in conventional mailers at much lower costs than conventional pill bottles and with lower risk of damage. However, a need arises for unitizing two or more containers in a single package for handling and shipment. These containers are described in more detail in Lee et al., U.S. Pat. No. 8,123,037, which is incorporated herein by reference.

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage.

The present invention successfully unitizes a plurality of generally flat pill containers into a package that may be safely shipped through conventional means.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
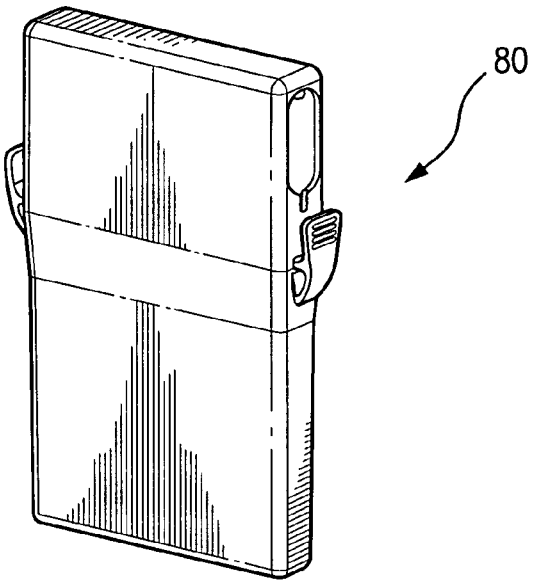
FIG. 1 is a front perspective view of a pill container according to one preferred embodiment of this invention.
Figure 2:
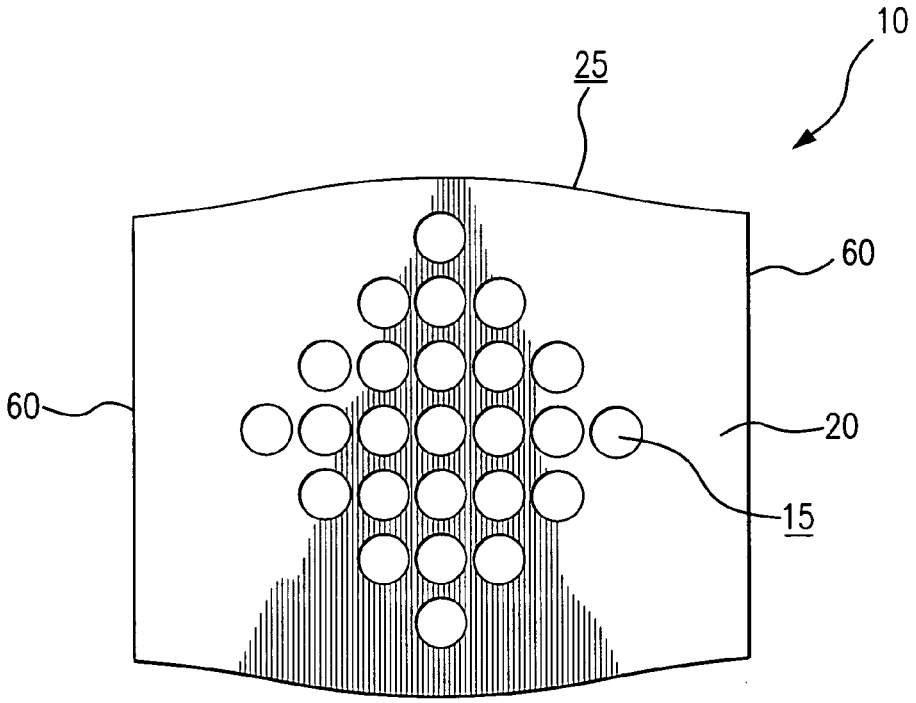
FIG. 2 is a side elevational view of a sleeve for unitizing two containers according to one preferred embodiment of this invention.
Figure 3:
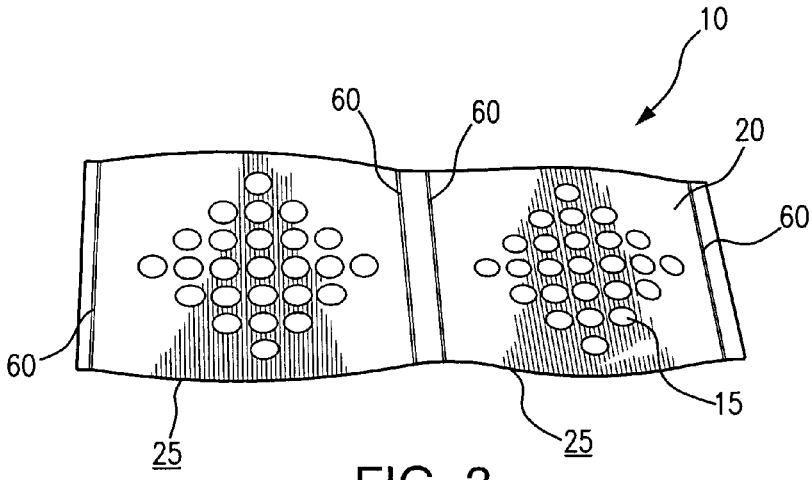
FIG. 3 is a side elevational view of a sleeve for unitizing four containers according to one preferred embodiment of this invention.

FIG. 1 shows an embodiment of a pill container 80 according to one preferred embodiment of this invention. The pill container 80 as described herein is preferably a generally flat housing with two parallel extending sidewalls and a slideable lockable cover. The pill container 80 or "container" 80 as used herein does not contemplate a generally cylindrical container having a threaded top as is conventionally associated with medication containers. FIGS. 2-4, 6 and 8 show a flexible sleeve 10 for unitizing a group of such containers 80 in groups of two, four, or more containers and a resulting unitized package 100. Embodiments of a resulting package are shown in FIGS. 5 and 7. Although FIGS. 2-8 illustrate various structures for flexible sleeve 10 of the invention, the illustrations are exemplary, and the invention is not limited to the flexible sleeves 10 or package 100 shown. For example, flexible sleeve 10 may be alternatively configured and used to unitize ten, fourteen or any other desired number of containers. The containers 80 are preferably, though not necessarily, like-sized within a single flexible sleeve 10.

Each flexible sleeve 10 preferably includes at least two layers of flexible sheet 20 having a width and length defining therein a central passage 25 for receiving a pair of containers 80 as described in more detail below. The passages 25 are preferably arranged in rows so as to form one or more passages 25, such as two adjacent passages 25 for a four container package 100 as shown in FIG. 5.

One or more voids 15 are preferably formed within one or both layers of flexible sheet 20 for weight reduction, aesthetics, labeling and/or improved flexibility of the sleeve 10. Such voids may be formed in a generally diamond pattern, with a logo or trademark, or any other preferred arrangement. It is preferable that corner portions of the sleeve 10 remain generally continuous for ease of insertion of individual containers 80 within the sleeve 10.

According to one preferred embodiment of this invention, such as shown in FIGS. 2-8, two layers of flexible sheet 20 are connected along two generally parallel edges, each with a weld 60 that joins the two layers of flexible sheet 20. The two layers of flexible sheet 20 may be coextruded, welded, or otherwise joined together to create the sleeve 10 and the resulting passage 25. A "weld" as used in the specification and claims may be defined as a hot weld, cold weld, lamination or any other manner of connection that joins two sheets of material known to those having ordinary skill in the art.

Figure 6:
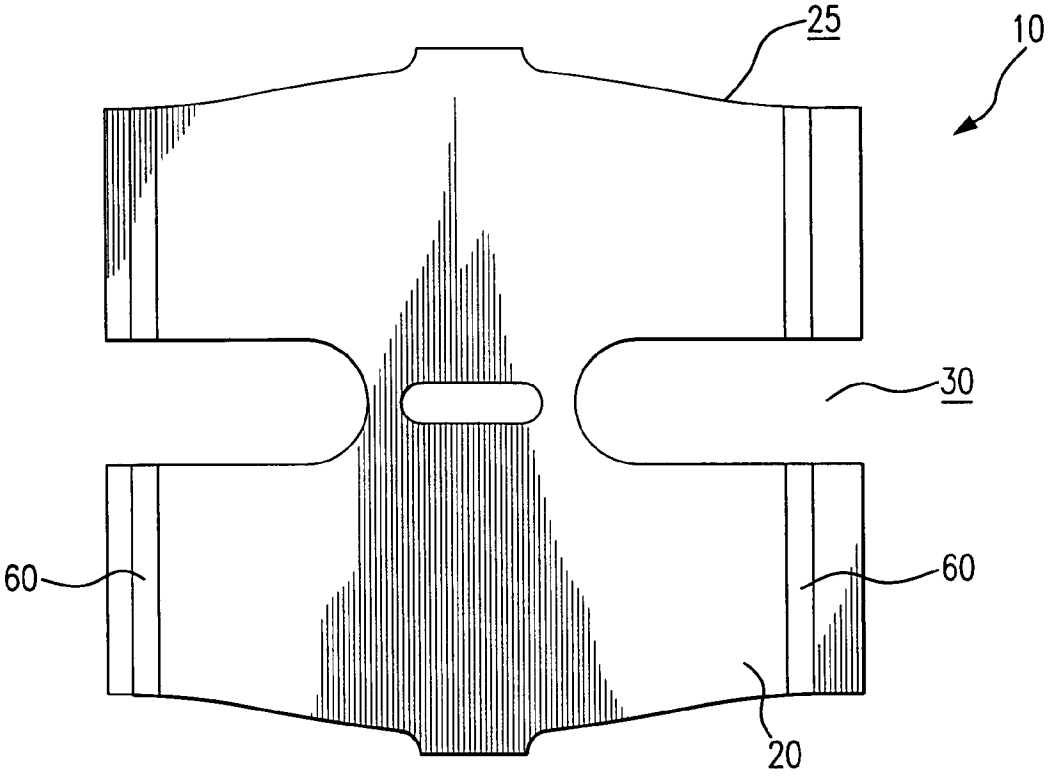
FIG. 6 is a side elevational view of a sleeve for unitizing four containers according to one preferred embodiment of this invention.
Figure 7:
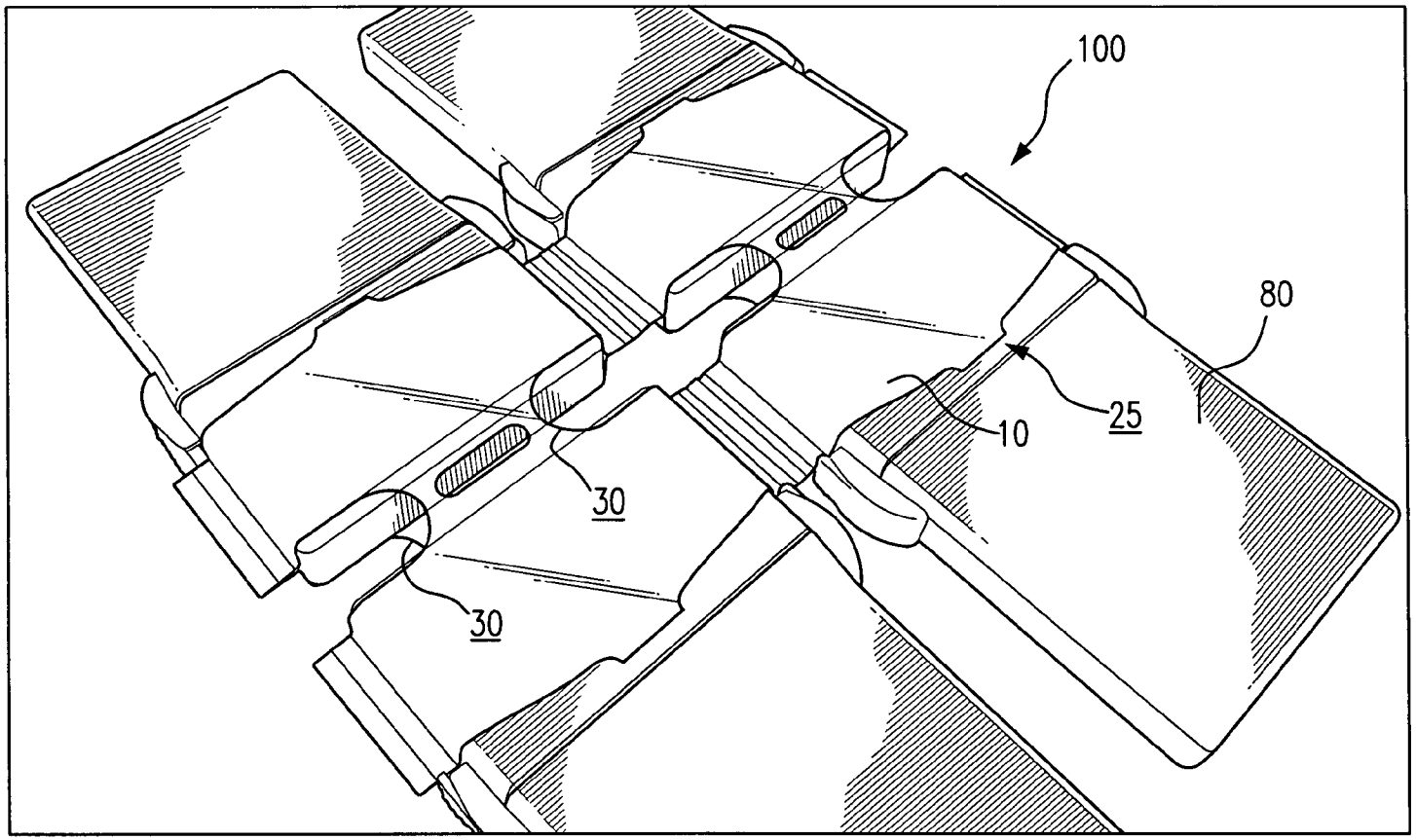
FIG. 7 is a top perspective view of a package according to one preferred embodiment of this invention.
Figure 8:
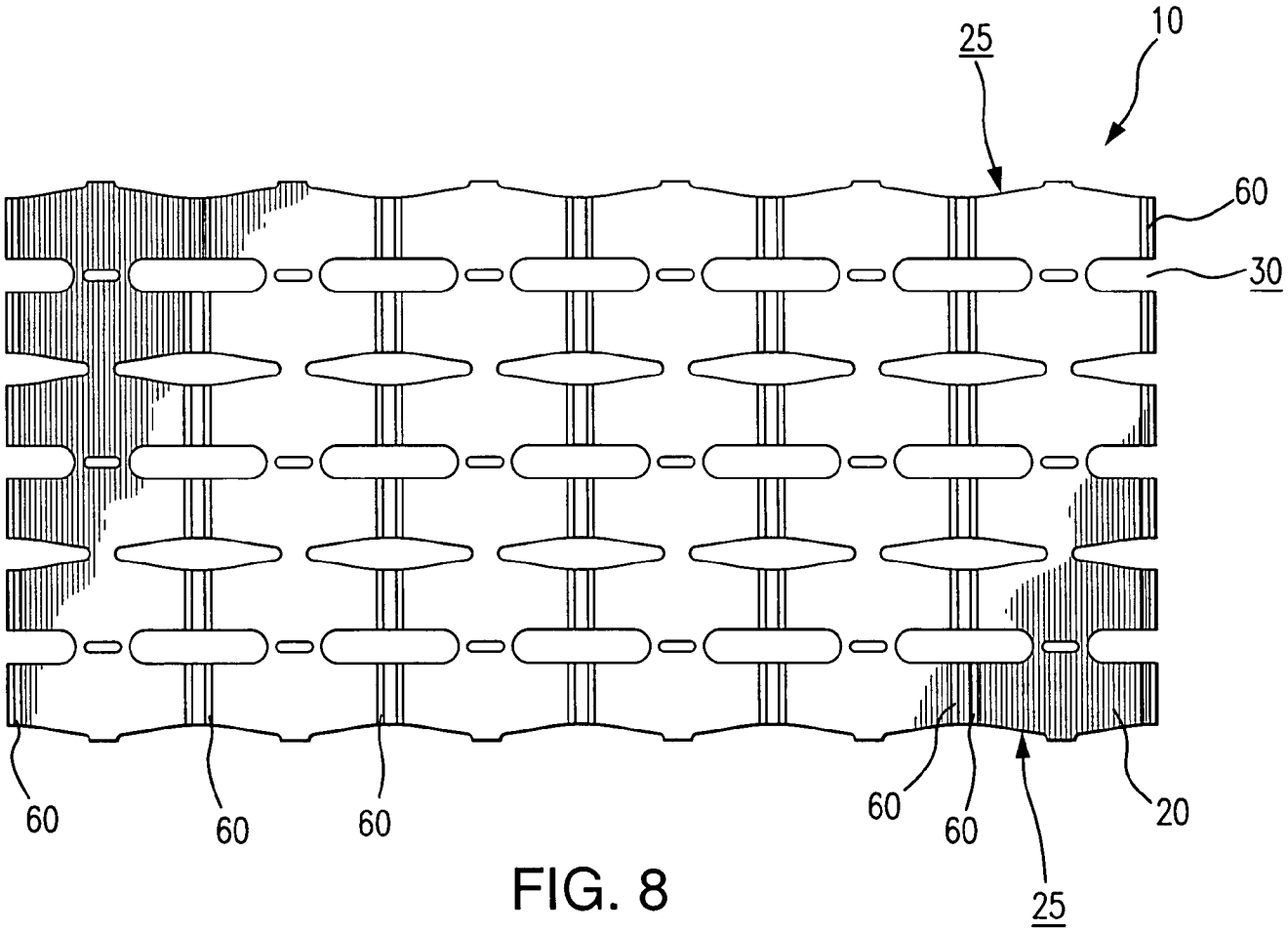
FIG. 8 is a side elevational view of a generally continuous array of sleeves according to one preferred embodiment of this invention.

As shown in FIGS. 6-8, sleeve 10 may further include a pair of cutouts 30 positioned generally between head ends of inserted containers 80 which permit greater flexibility between containers 80 when inserted into passage 25.

Figure 4:
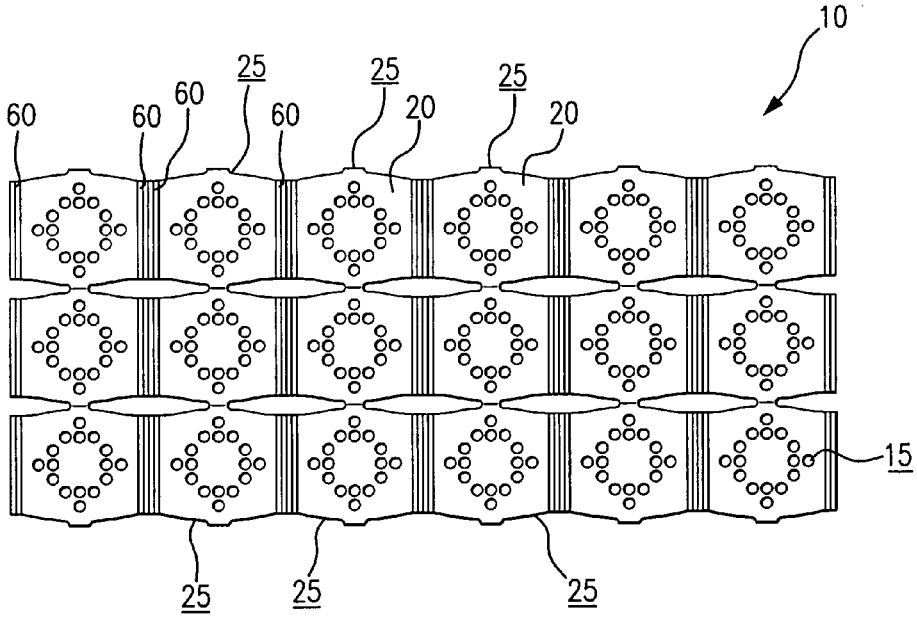
FIG. 4 is a side elevational view of a generally continuous array of sleeves according to one preferred embodiment of this invention.
Figure 5:
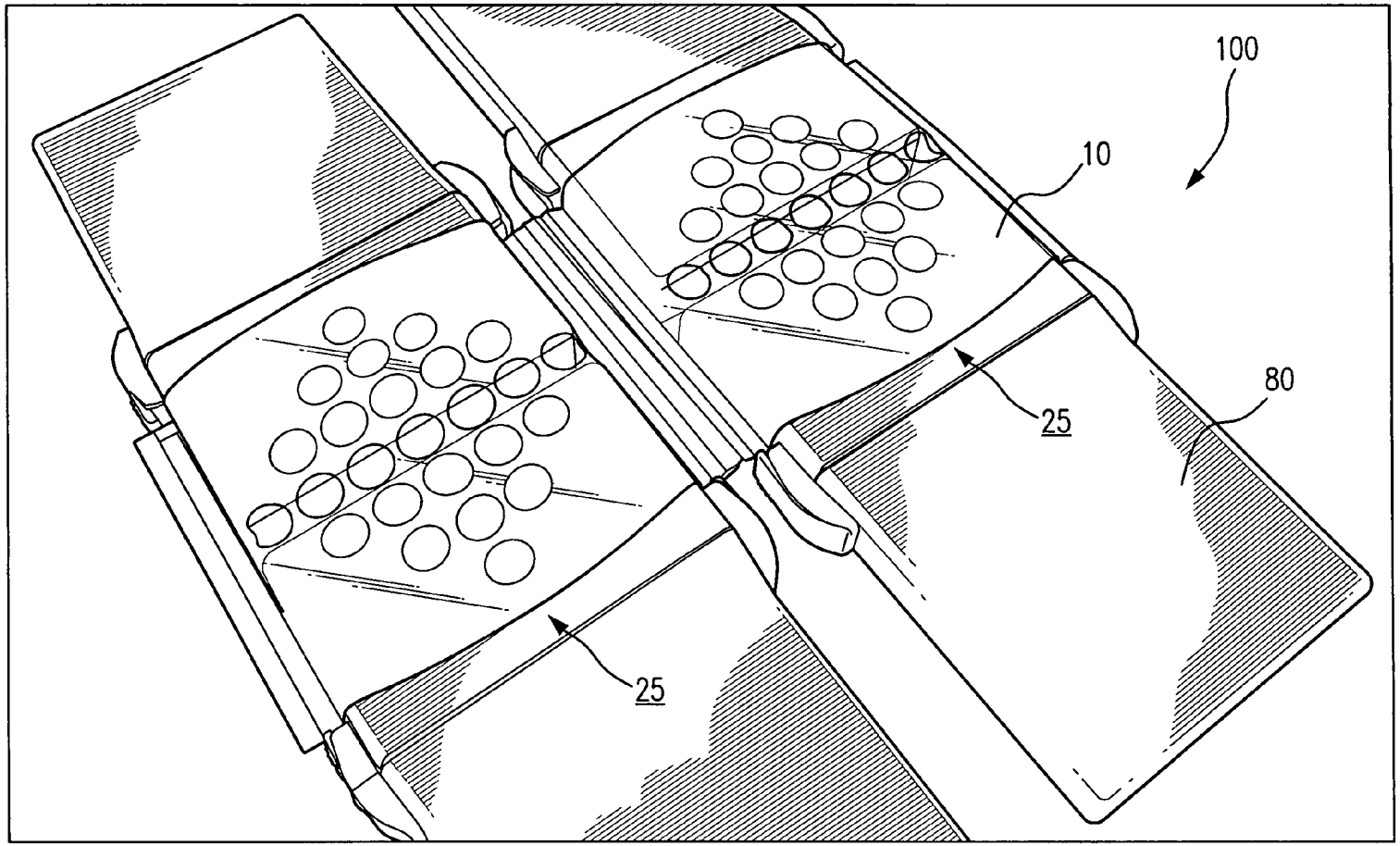
FIG. 5 is a top view of a package of containers according to one preferred embodiment of this invention.

As shown in FIG. 4, as a result of multiple adjacent sleeves 10 being formed in a generally continuous manner, an array of sleeves 10, such as shown in FIGS. 4 and 8, may be formed wherein a weld 60 is formed along an edge, then two central welds are formed, each providing a side edge of an adjacent sleeve 10, followed by two additional welds 60, continuing until an opposite side edge weld 60 is formed on an opposite side of the array. In this manner a generally continuous string of sleeves 10 may be manufactured. Between each pair of welds 60 dividing adjacent sleeves 10, a perforation or similar line of weakness may be formed to make the array easily dividable into smaller arrays or individual sleeves 10.

The package resulting from flexible sleeve 10 includes two or more unitized containers 80. Flexible sleeves 10 are generally applied to containers 80 by stretching flexible sheet 20 forming passage 25 around opposing containers 80, and requiring the stretched carrier 10 to recover, thereby providing a tight engagement to a pair of containers 80. FIGS. 5 and 7 show embodiments having four containers 80 each wherein two containers 80 are each positioned in adjacent passages 25.

As a result of the described configuration in one preferred embodiment of this invention, the containers 80 are maintained within the package 100 in a spaced apart and consistent manner such that when the package 100 is inserted within a mailing envelope, the individual containers 80 can move and flex relative to each other but are still unitized together. As a result of this described arrangement, the mailing envelope may be handled with conventional mail handling and processing equipment without destroying the contents or otherwise resulting in a more bulky and expensive mailing. In addition, by fixing the position of the containers 80 relative to each other, they do not have a tendency to disorient and stack or ride relative to each other. In addition, the sleeve 10 minimizes weight further reducing mailing costs.

According to one preferred embodiment of this invention as described above, the sleeve 10 is welded prior to application to individual containers 80. However, according to another preferred embodiment of this invention, the sleeve 10 may be welded during application to individual containers 80. In such a process, a first layer of flexible sheet 20 is positioned first and followed by placement of two or more containers 80 thereon. A second layer of flexible sheet 20 is overlayed the containers 80 and the first layer and welded along two generally parallel edges, each with a weld 60 that joins the two layers of flexible sheet 20 and thereby encloses the two or more containers 80 within the resulting passage 25.

According to yet another embodiment of this invention, two layers of flexible sheet 20 may be relatively offset such that a first layer has a different length than a second layer thereby creating a larger passage 25 when the two layers are welded. Likewise, one layer of flexible sheet 20 may be pre-stretched or pre-slacked prior to welding to result in a sleeve 10 having a desirable passage 25 for insertion or placement of the containers 80. In this manner, the containers 80 may be later inserted or inserted in process as described above.

Figure 9:
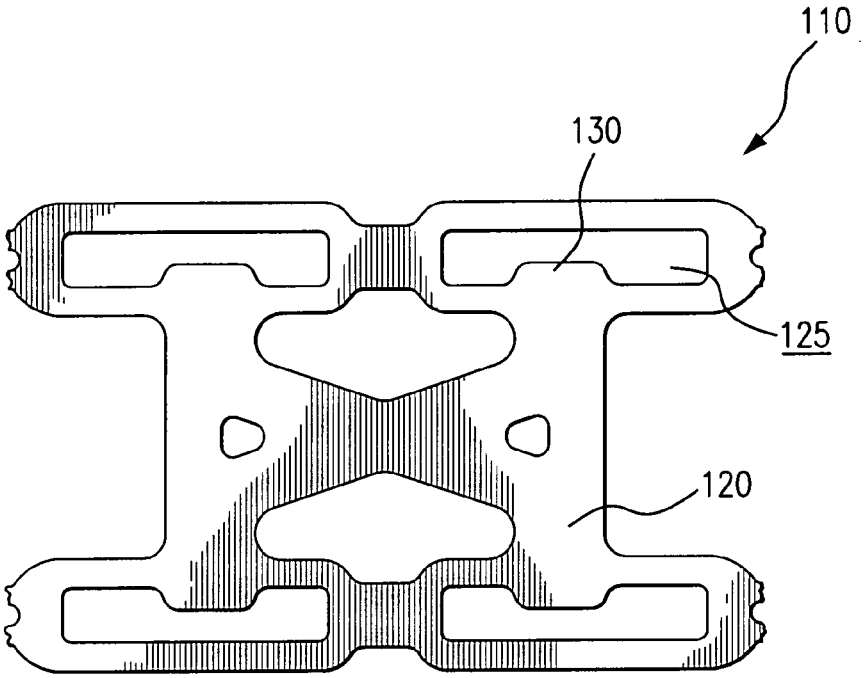
FIG. 9 is a side elevational view of a flexible carrier according to one preferred embodiment of this invention.
Figure 10:
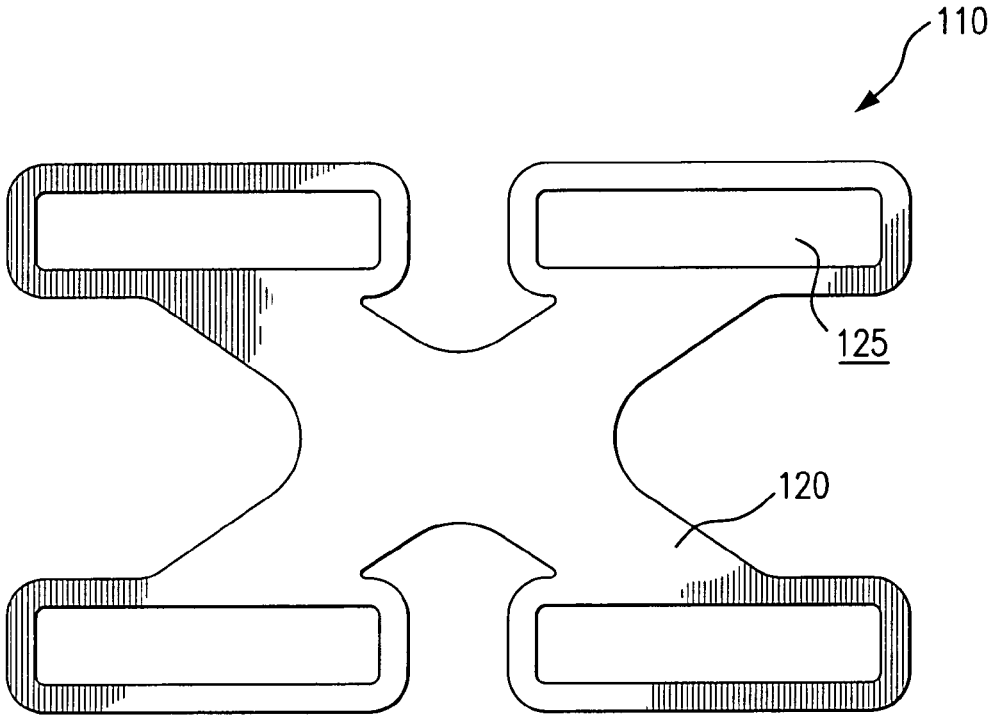
FIG. 10 is a side elevational view of a flexible carrier according to one preferred embodiment of this invention.
Figure 11:
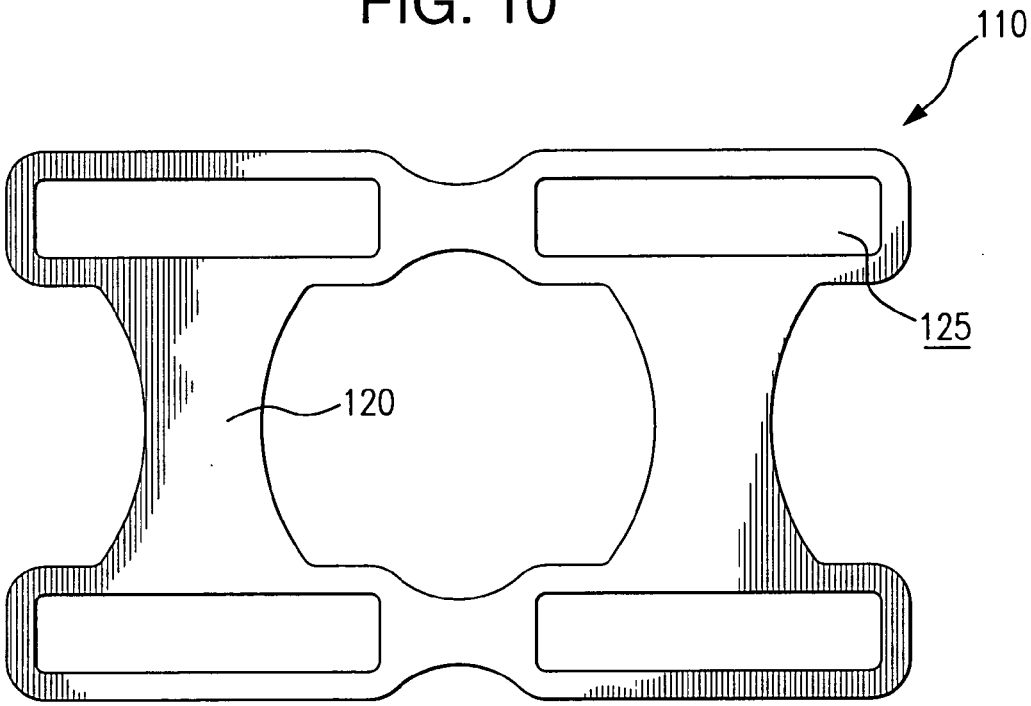
FIG. 11 is a side elevational view of a flexible carrier according to one preferred embodiment of this invention.
Figure 12:
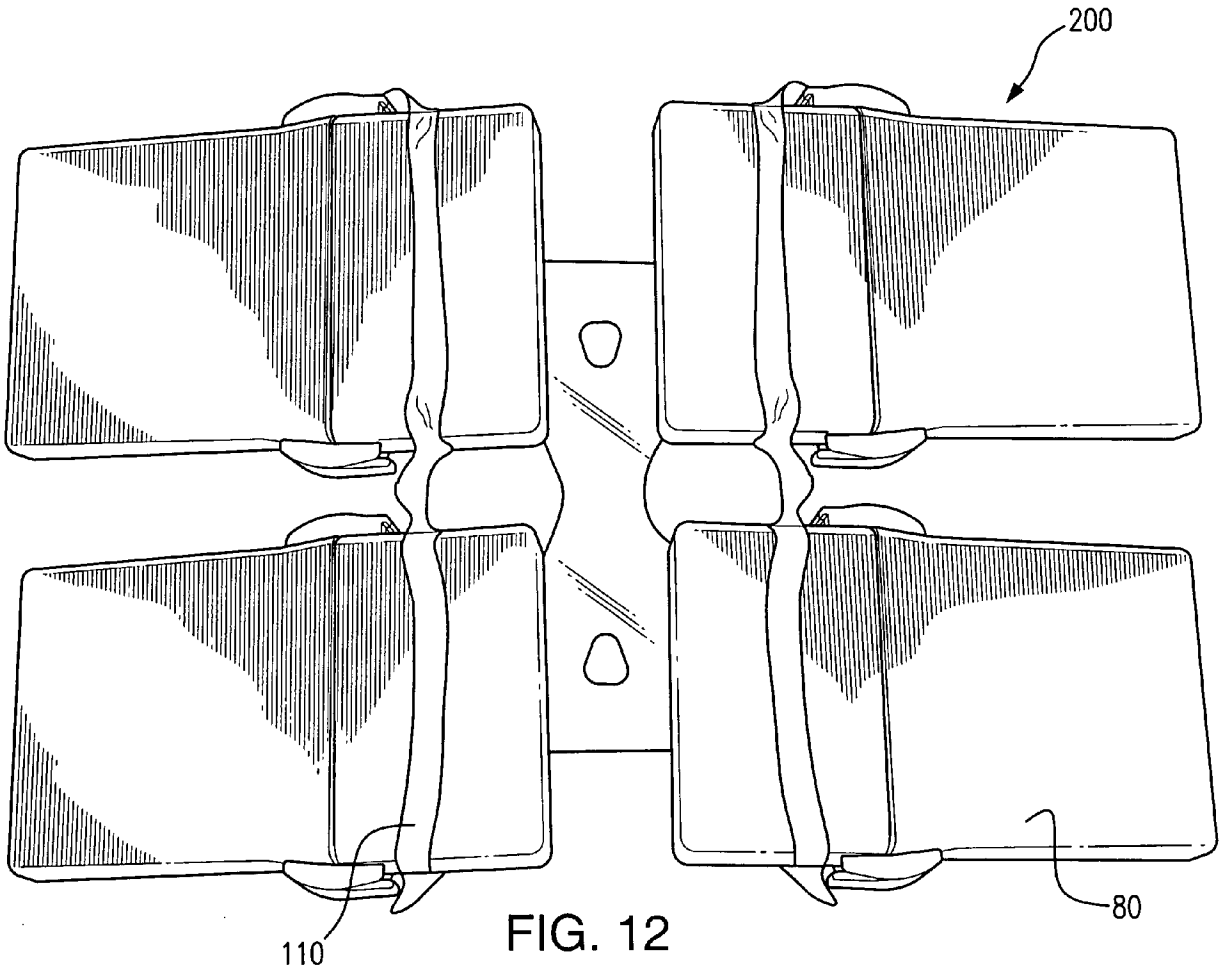
FIG. 12 is a top view of a package of containers according to one preferred embodiment of this invention.

According to another preferred embodiment, FIGS. 9-11 show flexible carrier 110 for unitizing a group of such containers 80 in groups of two, four, or more containers and a resulting unitized package 200. One embodiment of a resulting package is shown in FIG. 12. Although FIGS. 9-12 illustrate various structures for flexible carrier 110 of the invention, the illustrations are exemplary, and the invention is not limited to the flexible carriers 110 or packages shown. For example, flexible carrier 110 may be alternatively configured and used to unitize ten, fourteen or any other desired number of containers. The containers 80 are preferably, though not necessarily, like-sized within a single flexible carrier 110.

Each flexible carrier 110 preferably includes at least one layer of flexible sheet 120 having a width and length defining therein a plurality of container receiving apertures 125, each for receiving a container 80. The plurality of container receiving apertures 125 are preferably arranged in longitudinal rows and longitudinal ranks so as to form an array of container receiving apertures 125, such as two rows by two ranks for a four container package 200 as shown in FIG. 5. Container receiving apertures 125 are preferably generally rectangular however they may include a tab 130 or similar feature for maintaining the container 80 in the desired position within the package 200.

The package resulting from flexible carrier 110 includes a plurality of unitized containers. Flexible carriers 110 are generally applied to containers by stretching flexible sheet 120 surrounding container receiving apertures 125 around container 80, and requiring the stretched carrier 110 to recover, thereby providing a tight engagement.

As a result of the described configuration in one preferred embodiment of this invention, the containers 80 are maintained within the package 200 in a spaced apart and consistent manner such that when the package 200 is inserted within a mailing envelope, the individual containers can move and flex relative to each other but are still unitized together. As a result of this described arrangement, the mailing envelope may be handled with conventional mail handling and processing equipment without destroying the contents or otherwise resulting in a more bulky and expensive mailing. In addition, by fixing the position of the containers 80 relative to each other, they do not have a tendency to disorient and stack or ride relative to each other. In addition, the carrier 110 minimizes weight further reducing mailing costs.

While in the foregoing specification this invention has been described in relation to certain preferred embodiments thereof, and many details have been set forth for purpose of illustration, it will be apparent to those skilled in the art that flexible sleeve 10, carrier 110 and package 100, 200 are susceptible to additional embodiments and that certain of the details described herein can be varied considerably without departing from the basic principles of the invention.

We claim:

1. A multipackage for distributing multiple containers of a plurality of items, the multipackage comprising:

two or more containers, each container having a generally rectangular cross-section;

a flexible plastic sleeve having two layers of a flexible sheet and a weld forming a passage that accommodates the containers in a unitized array of two or more containers, wherein the two containers are positioned within the passage with the respective head ends facing each other and are thus inserted containers; and a pair of cutouts positioned between the respective head ends of the inserted containers.

2. The multipackage of claim 1 comprising at least two rows of flexible plastic sleeves arranged in an array to unitize multiple containers, thereby forming adjacent sleeves.

3. The multipackage of claim 2 wherein adjacent sleeves are connected to each other along two welds, each weld forming an edge of one sleeve of the adjacent sleeves.

4. The multipackage of claim 1 wherein the flexible plastic sleeve includes one or more voids arranged in a central portion of the flexible plastic sleeve.

5. An apparatus for packaging medication comprising:

a plurality of containers having a generally rectangular cross-section, each container for holding medication;

one or more flexible sleeves, each flexible sleeve for accommodating two containers arranged in transverse ranks; and wherein the two containers are positioned within the passage with the respective head ends facing each other and are thus inserted containers; and a pair of cutouts positioned between the respective head ends of the inserted containers.

6. The apparatus of claim 5 wherein each flexible sleeve is formed by a pair of welds across two layers of a flexible sheet, a resulting flexible sleeve forming a passage into which two containers are inserted.

7. The apparatus of claim 6 wherein the flexible sleeves are formed in multiple rows.

8. The apparatus of claim 5 wherein an array of flexible sleeves is formed to accommodate a plurality of container pairs.

9. The apparatus of claim 8 wherein the containers are individually separable from the array.

* * * * *